US008737663B2

(12) United States Patent
Jilani et al.

(10) Patent No.: US 8,737,663 B2
(45) Date of Patent: May 27, 2014

(54) ACOUSTIC ENERGY TRANSDUCER

(75) Inventors: Adel Jilani, Corvallis, OR (US); James McKinnell, Salem, OR (US); Jennifer Wu, Corvallis, OR (US); Melinda Valencia, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 273 days.

(21) Appl. No.: 13/140,329

(22) PCT Filed: Jan. 27, 2009

(86) PCT No.: PCT/US2009/032100

§ 371 (c)(1),
(2), (4) Date: Jun. 16, 2011

(87) PCT Pub. No.: WO2010/087816

PCT Pub. Date: Aug. 5, 2010

(65) Prior Publication Data

US 2011/0249853 A1 Oct. 13, 2011

(51) Int. Cl.
*H04R 1/02* (2006.01)

(52) U.S. Cl.
USPC ..... 381/369; 381/175; 381/174; 381/113; 381/191; 381/398

(58) Field of Classification Search
None
See application file for complete search history.

(56) References Cited

U.S. PATENT DOCUMENTS

| | | | | |
|---|---|---|---|---|
| 4,182,937 | A * | 1/1980 | Greenwood | 381/162 |
| 4,651,120 | A * | 3/1987 | Aagard | 338/4 |
| 4,761,582 | A | 8/1988 | McKee | |
| 4,766,666 | A * | 8/1988 | Sugiyama et al. | 29/621.1 |
| 5,242,863 | A * | 9/1993 | Xiang-Zheng et al. | 438/53 |
| 5,629,906 | A | 5/1997 | Sudol | |
| 5,956,292 | A * | 9/1999 | Bernstein | 367/140 |
| 6,577,742 | B1 | 6/2003 | Bruney | |
| 7,623,142 | B2 * | 11/2009 | Jilani et al. | 359/290 |
| 2003/0094047 | A1 | 5/2003 | Torkkeli | |
| 2007/0113658 | A1 | 5/2007 | Combi et al. | |
| 2008/0137884 | A1 | 6/2008 | Kim et al. | |
| 2009/0031818 | A1 * | 2/2009 | McKinnell et al. | 73/727 |

FOREIGN PATENT DOCUMENTS

| | | |
|---|---|---|
| CN | 101106835 | 1/2008 |
| JP | 2006-302943 | 11/2006 |

* cited by examiner

*Primary Examiner* — Curtis Kuntz
*Assistant Examiner* — Thomas Maung

(57) ABSTRACT

Illustrative acoustic transducers are provided. A monolithic semiconductor layer defines a plate, two or more flexible extensions and at least a portion of a support structure. Acoustic pressure transferred to the plate results in tensile strain of the flexible extensions. The flexible extensions exhibit varying electrical characteristics responsive to the tensile strain. An electric signal corresponding to the acoustic pressure can be derived from the varying electrical characteristics and processed for further use.

14 Claims, 4 Drawing Sheets

ACOUSTIC ENERGY TRANSDUCER

BACKGROUND

Acoustic energy propagates through physical media in the form of waves. Such acoustic energy is commonly referred to as sound when the propagating frequency is within the human hearing range. Electronic detection of acoustic energy is germane to numerous areas of technical endeavor, including sound recording, sonar, health sciences, and so on.

A microphone is a transducer that exhibits some electrical characteristic that varies in accordance with the acoustic energy incident thereto. Such a varying electrical characteristic is, or is readily convertible to, an electrical signal that emulates the amplitude, frequency and/or other aspects of the detected acoustic energy.

Accordingly, the embodiments described hereinafter were developed in the interest of improved microphone design.

BRIEF DESCRIPTION OF THE DRAWINGS

The present embodiments will now be described, by way of example, with reference to the accompanying drawings, in which.

DETAILED DESCRIPTION

Introduction

Means for microphones and other acoustic transducers are provided by the present teachings. A plate is displaced under the influence of acoustic pressure. Two or more flexures extend away from the plate in respective directions and are subject to tensile strain as a result of the acoustic pressure. The flexures support one or more sensors, or are doped or otherwise configured to exhibit a varying electrical characteristic responsive to the tensile strain. An electric signal corresponding to the acoustic pressure is derived from the varying electrical characteristics exhibited by the flexures.

In one embodiment, an apparatus includes a flexure layer defining a plate and a first flexible portion and a second flexible portion. Each of the first and second flexible portions is configured to exhibit a varying electrical characteristic in response to an acoustic pressure communicated to the plate. The first flexible portion and the second flexible portion extend directly away from the plate in respective opposite directions.

In another embodiment, a microphone includes a flexure layer of monolithic material. The flexure layer is formed to define a plate, a first flexible extension and a second flexible extension. The first and second flexible extensions extend away from the plate in respective opposite directions. The microphone also includes a spine layer that covers the plate defined by the flexure layer. The microphone further includes a membrane layer that covers the spine layer. The first and second flexible extensions are each configured to exhibit an electrical characteristic that varies in accordance with an acoustic pressure incident to the membrane layer.

In yet another embodiment, a transducer is configured to exhibit an electrical characteristic that varies in accordance with an incident acoustic pressure. The transducer includes a monolithic semiconductor layer that is configured to define a plate, a first extension and a second extension. The first extension and the second extension extend away from the plate in respective opposite directions. Each of the first and second extensions is configured such that the electrical characteristic is either piezoresistive or piezoelectric in nature. The monolithic semiconductor layer further defines at least a portion of a support structure. The support structure defines an acoustic cavity proximate to the plate.

First Illustrative Embodiment

Figure 1:
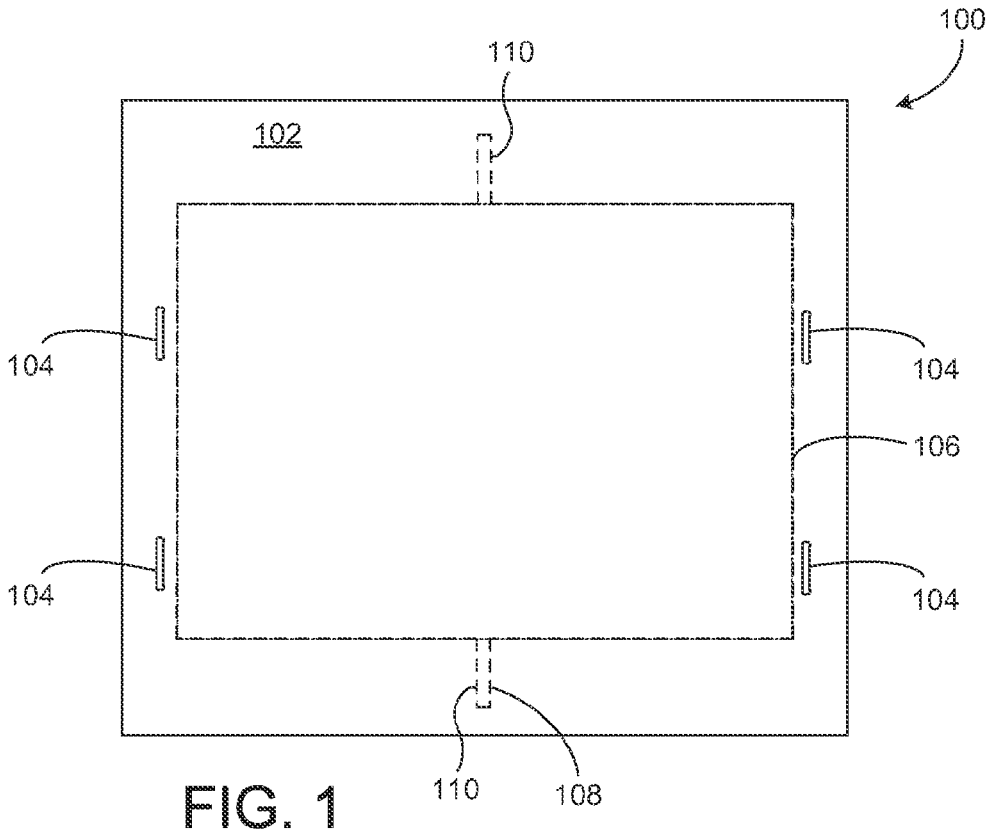
FIG. 1 depicts a plan view of a microphone according to one embodiment.
Figure 1A:
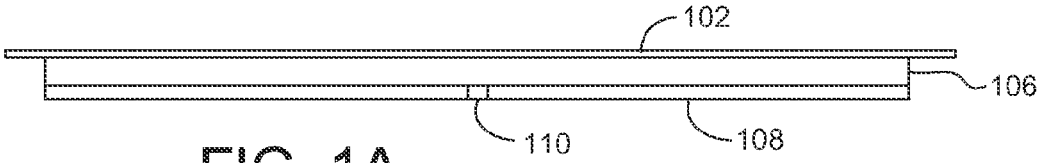
FIG. 1A depicts a front elevation view of the microphone of FIG. 1.
Figure 1B:
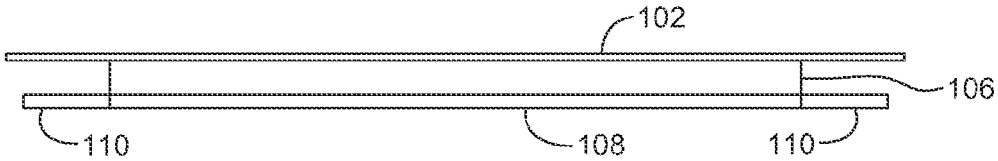
FIG. 1B depicts a side elevation view of the microphone of FIG. 1.

FIG. 1 depicts a plan view of a microphone element (microphone) 100 according to one embodiment. Simultaneous reference is also made to FIGS. 1A and 1B, which depict a front elevation view and a side elevation view of the microphone 100, respectively. The microphone 100 includes membrane 102. The membrane 102 can be formed from any suitable, semi-flexible material such as, for non-limiting example, Nickel, Tantalum aluminum alloy, silicon nitride, silicon oxide, silicon oxy-nitride, Si, SU-8, or another photo-definable polymer, etc. Other materials can also be used. The membrane 102 is disposed to have acoustic energy (e.g., sound waves, etc.) incident there upon during typical operation of the microphone 100.

The membrane 102 is formed so as to define a one or more through apertures, or vents, 104. Each of the vents 104 is configured to permit the passage of ambient gas (e.g., air, etc.) there through during typical operation of the microphone 100. Further elaboration on the operation of the microphone 100 is provided hereinafter.

The microphone 100 also includes a spine (layer) 106. The spine 106 is bonded to and generally underlies the membrane 102. The spine 106 can be formed from any suitable material. In a typical embodiment, the spine layer 106 is formed from silicon, silicon oxide, or another suitable semiconductor material. In any case, the spine 106 is configured to provide additional structural rigidity and strength to the microphone 100.

The microphone 100 further includes a flexure layer 108. The flexure layer 108 is formed from any suitable material such as silicon, a semiconductor material, etc. Other materials can also be used. The flexure layer 108 is further configured to define a pair of flexible extensions (or flexures) 110. The flexible extensions 110 extend away from the flexure layer 108 in respectively opposite directions.

Each flexure 110 is configured to flexibly strain under the influence of acoustic pressure incident to the membrane 102. The strain is then transferred to one or more sensors (not shown in FIGS. 1-1B) which exhibit a varying electrical characteristic in response to the acoustic pressure. In another embodiment, each flexure 110 is doped or otherwise modified so as to exhibit piezoresistive or piezoelectric characteristics, and no discrete sensors as such are included. In any case, the electrical characteristic of each flexure 110 can be electrically coupled to other circuitry (not shown) such that an electrical signal corresponding to the acoustic pressure incident to the membrane 102 is derived.

The flexure layer 108 including the flexures 110 are typically—but not necessarily—formed from semiconductor such as silicon and are shaped using known techniques such as masking, etching, etc. The pair of flexures 110 mechanically couples the flexure layer 108 to a surrounding support structure (not shown). In one or more embodiments, the support structure (not shown) and the flexure layer 108 (including the flexible extensions 110) are contiguous in nature, being etched, cut, or otherwise suitably formed from a monolithic layer of material.

The spine 106 is a continuous sheet or layer of material overlying and continuously bonded to a bulk area of the flexure layer 108. Thus, the spine 106 covers all but the flexures 110 of the flexure layer 108. In turn, the membrane 102 overlies and is continuously bonded to the spine 106. The membrane 102 is defined by an overall area that exceeds and extends outward from the area of the spine 106. Illustrative and non-limiting dimensions for an embodiment of microphone 100 are provided in Table 1 below (1 μM=$1\times10^{-6}$ Meters):

TABLE 1

| Element | Width | Length | Thickness |
|---|---|---|---|
| Membrane 102 | 400 μM | 400 μM | 0.1 μM |
| Spine 106 | 300 μM | 300 μM | 6 μM |
| Flexures 110 | 6 μM | 25 μM | 2 μM |

It is noted that a significant portion of the flexure layer 108 is of the same area dimensions as the overlying spine 106. This significant portion of the flexure layer 108 is referred to herein as a "plate area" or "plate" for the flexure layer 108.

Second Illustrative Embodiment

Figure 2:
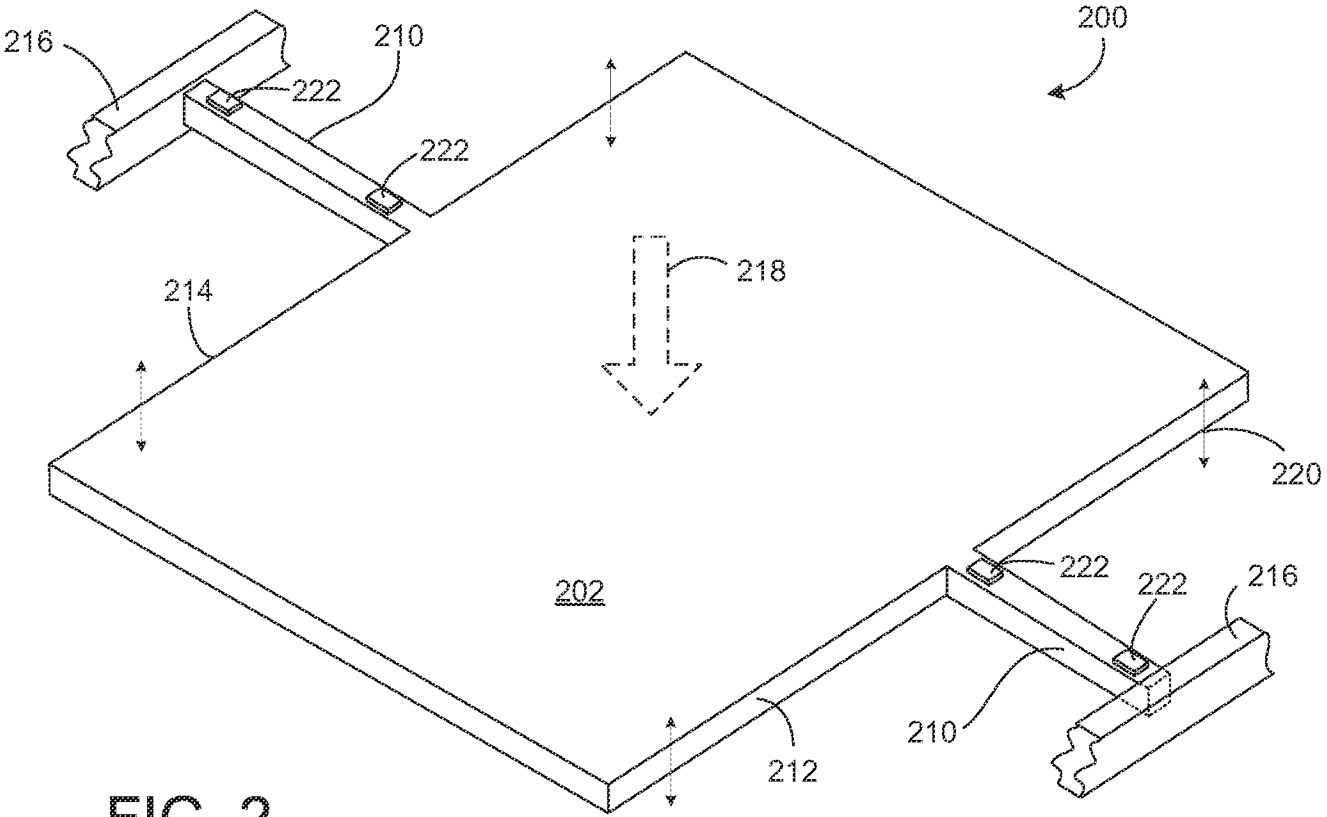
FIG. 2 depicts an isometric view a flexure layer according to one embodiment.

FIG. 2 depicts an isometric view of an illustrative and non-limiting flexure layer 200 according to one embodiment. The flexure layer 200 is understood to be part of a microphone (e.g., 100) including other elements (not shown) such as, for non-limiting example, a membrane (e.g., 102), a spine (e.g., 106), etc. Thus, the flexure layer 200 is a portion of a greater microphone construct according to the present teachings, and various associated elements are not shown in the interest of simplicity. The flexure layer 200 is formed from silicon such that an overall monolithic structure is defined as described hereinafter.

The flexure layer 200 defines a plate area (plate) 202. The plate 202 accounts for the bulk (i.e., material majority) of the flexure layer 200. The plate 202 is understood to be bonded to a spine layer of material (not shown) of corresponding area.

The flexure layer 200 also defines a pair of flexible extensions (or flexures) 210. The flexible extensions 210 extend away from the flexure layer 200 at respective opposite edges 212 and 214. Thus, the flexible extensions 210 extend away from the plate 202 in respective opposite directions. The flexible extensions 210 couple the plate 202 to a support structure 216. The flexible extensions 210 are configured to exhibit tensile strain under the influence of acoustic pressure 218, resulting in displacement of the plate 202 as indicated by the double arrow 220.

The flexible extensions 210 each support a plurality of piezoresistive sensors 222. The piezoresistive sensors 222 are each configured to provide an electrical resistance (i.e., exhibit an electrical characteristic) that varies in accordance with acoustic pressure 218 transferred to the plate 202 of the flexure layer 200. The corresponding electrical resistance is understood to be coupled to other electronic circuitry (not shown) for electrical signal derivation, amplification, filtering, digital quantization, signal processing, etc., as needed so that the detected acoustic pressure 218 can be suitably utilized.

A total of two piezoresistive sensors 222 are depicted in FIG. 2. In another embodiment, a different number of piezoresistive (or piezoelectric) sensors are used. In still another embodiment (not shown), the flexible extension has been doped or otherwise modified so to exhibit a piezoresistive, piezoelectric, or other electrical characteristic that varies in accordance with acoustic pressure communicated (i.e., transferred or coupled) to the flexure layer.

During typical operation, acoustic pressure 218 is incident to a membrane that overlies and is mechanically coupled to the flexure layer 200. Please refer to FIGS. 1-1B for analogous illustration. The acoustic pressure 218 is understood to be defined by various characteristics including amplitude and frequency. Furthermore, the amplitude, frequency, and/or other characteristics of the acoustic pressure 218 may be essentially constant or time-varying. The membrane couples or communicates the acoustic pressure 218 to a spine that, in turn, communicates the acoustic pressure 218 to the plate 202 of the flexure layer 200.

The flexure layer 200 shifts in position by way of tensile strain of the flexible extensions 210. The tensile strain of flexures 210 is further coupled to the two piezoresistive sensors 222, which respond by producing a correspondingly varying electrical resistance. The electrical resistance, or signal, is understood to be coupled to electronic circuitry (not shown) by wiring or other suitable conductive pathways. As depicted, the piezoresistive sensors 222 are located near end portions where of the respective extensions 210 so as to be subject to maximum strain during operation.

The flexure layer 200 (including the plate 202 and the flexures 210) and at least a portion of the supporting structure 216 are formed from a single layer of semiconductor material. Thus, the flexure layer 200 and the support structure 216 are a monolithic structure formed by etching, cutting and/or other suitable operations. In a typical and non-limiting embodiment, the supporting structure 216 and/or other material(s) (not shown) define an acoustic cavity within which the plate 202 is suspended by virtue of the flexures 210. Other configurations for supporting the plate 202 can also be used. Further illustrative detail regarding such an acoustic cavity is provided hereinafter.

Third Illustrative Embodiment

Figure 3:
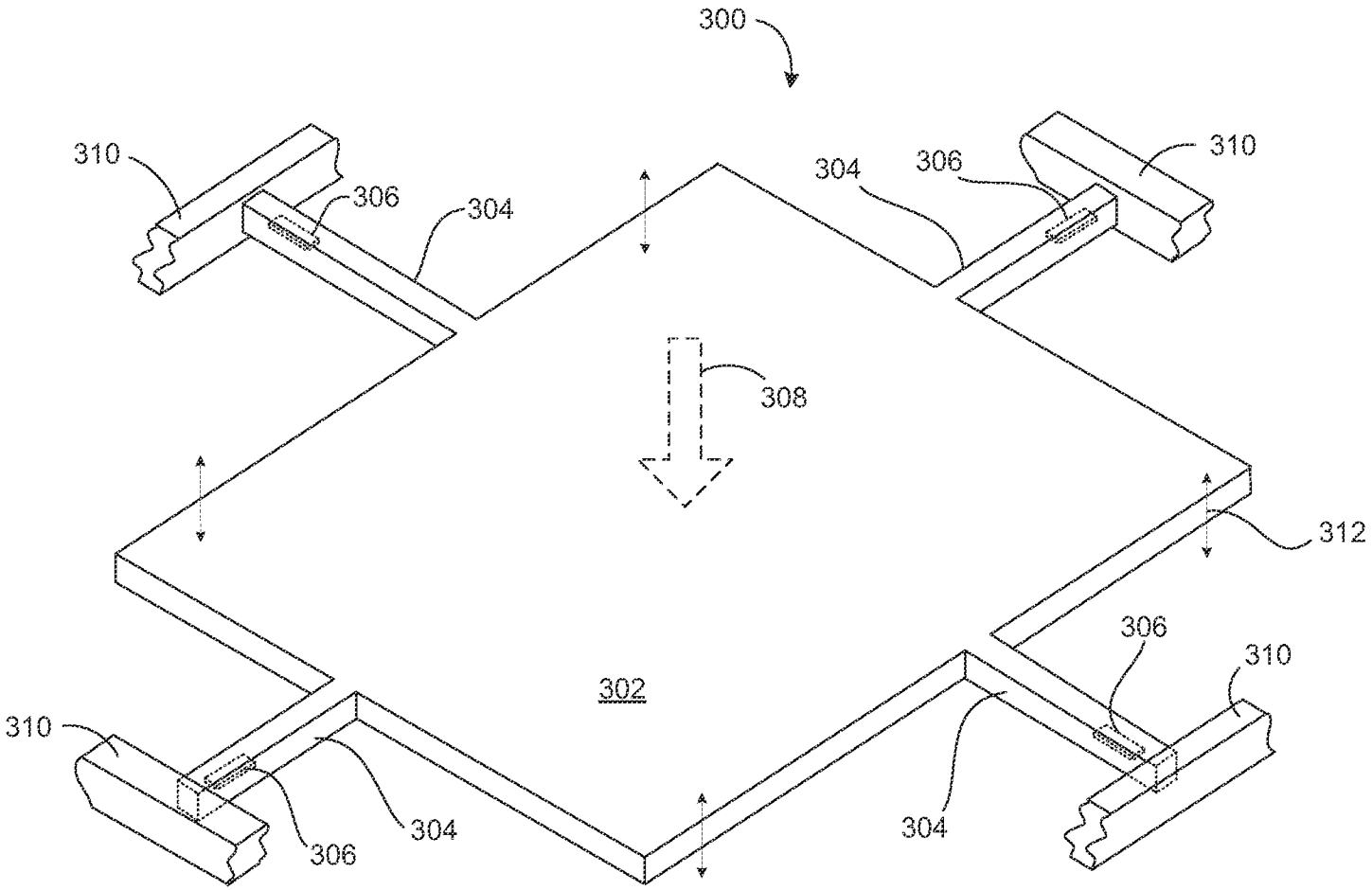
FIG. 3 depicts an isometric view a flexure layer according to another embodiment.

FIG. 3 depicts an isometric view of an illustrative and non-limiting flexure layer 300 according to one embodiment. The flexure layer 300 is understood to be part of a microphone (e.g., 100) including other elements (not shown) such as, for non-limiting example, a membrane (e.g., 102), a spine (e.g., 106), etc. Thus, the flexure layer 300 is a portion of a greater microphone construct according to the present teachings, and various associated elements are not shown in the interest of simplicity. The flexure layer 300 is formed from silicon such that an overall monolithic structure is defined as described hereinafter.

The flexure layer 300 includes a plate 302 and four flexible extensions (or flexures) 304. The flexible extensions 304 extend away from the plate 302 in respectively different directions. Each of the flexures 304 is doped or otherwise modified so as to exhibit piezoresistive characteristics. These piezoresistive characteristics are depicted as discrete regions 306 in the interest of simplicity. However, one of ordinary skill in the semiconductor arts will appreciate that such piezoresistive doping or other modification to the respective flexures 304 can involve varying volumes and relative shapes in order to achieve desired performance.

In any case, the four flexures 304 are configured to exhibit an electrical resistance that varies in accordance with an acoustic pressure 308 that is communicated to the plate 302.

The plate 302 is mechanically coupled to and supported by a support structure 310 by way of the four flexible extensions 304. The doped regions 306 are typically, but not necessarily, located near end portions of the respective flexures 304 such that maximum strain is coupled to the doped regions 306 during operation.

During typical operation, acoustic pressure 308 is incident to a membrane that overlies and is mechanically coupled to the plate 302 of the flexure layer 300. Please refer to FIGS. 1-1B for analogous illustration. The acoustic pressure 308 is understood to be defined by various characteristics, which may be essentially constant or time-varying, respectively. The membrane couples or communicates the acoustic pressure 308 to a spine that, in turn, communicates the acoustic pressure 308 to the plate 302. Such acoustic pressure 308 causes displacement of the plate 302 as indicated by double-arrow 312.

Displacement of the plate 302 occurs by virtue of tensile strain of the flexible extensions 304. The tensile strain of the flexures 304 is further coupled to the piezoresistive regions 306, which respond by producing a correspondingly varying electrical resistance. These electrical resistances, or signals, are understood to be coupled to electronic circuitry (not shown) by wiring or other suitable conductive pathways.

The flexure layer 300 (including the plate 302 and the four flexures 304) and at least a portion of the supporting structure 310 are formed from a single layer of semiconductor material. Thus, the flexure layer 300 and the supporting structure 310 are a monolithic structure formed by etching, cutting and/or other suitable operations. In a typical and non-limiting embodiment, the supporting structure 310 and/or other material(s) (not shown) define an acoustic cavity in which that plate 302 is suspended by way of the flexures 304. Other configurations for supporting the plate 302 can also be used. Further illustrative detail regarding such an acoustic cavity is provided hereinafter.

Illustrative Operation

Figure 4:
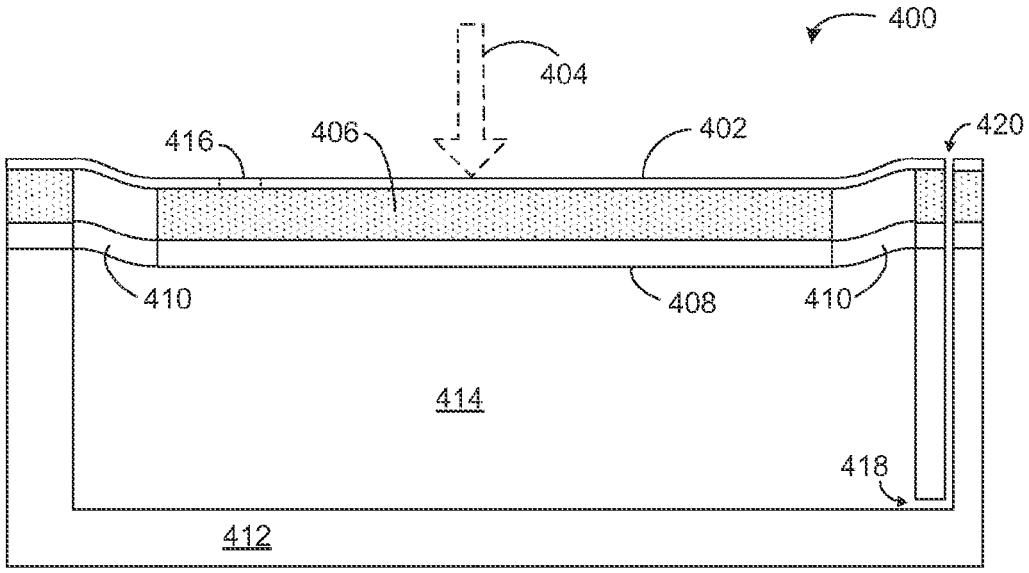
FIG. 4 depicts a side elevation sectional view of an illustrative microphone operation according to the present teachings.

FIG. 4 is a side elevation sectional view depicting a microphone element (microphone) 400 according to one embodiment under illustrative and non-limiting operating conditions. The microphone 400 includes a membrane 402. The membrane 402 is semi-rigid in nature, configured to flexibly deform (strain) under the influence of incident acoustic pressure 404 and return to a substantially planar resting state in the absence of acoustic pressure 404.

The microphone 400 also includes a spine layer 406 and flexure layer 408. The flexure layer 408 is configured (i.e., formed) to define a pair of flexible extensions or flexures 410. The membrane 402, the spine layer 406 and the flexure layer 408 are defined from corresponding layers of material by way of etching, cutting, and/or other suitable techniques known to one of ordinary skill in the semiconductor fabrication arts. The microphone 400 includes an underlying substrate 412 of silicon or other semiconductor material.

The respective material layers of the microphone 400 are formed such that an acoustic cavity 414 is defined. The acoustic cavity 414 is fluidly coupled to an ambient environment about the microphone 400 by way of one or more vents 416 formed within the membrane 402, as well as by way of a passageway 418 leading to a vent 420. In another embodiment, other combinations of passageways and/or vents can be used. Ambient gases (e.g., air, etc.) are permitted to pass in and out of the acoustic cavity 414 by way of the vents 416 during normal operations of the microphone 400.

The flexure layer 408 is coupled to and supported by the surrounding material layer from which it is formed by way of the pair of flexures 610. Additionally, the membrane 402 overlaps the spine layer 406 and the flexure layer 408, extending outward over at least a portion of the material layers of the microphone 400. In turn, the spine layer 406 is discretely defined apart from the material layer from which it is formed. In this way, the flexure layer 408 is generally suspended (i.e. supported) within the acoustic cavity 414.

As depicted, an acoustic pressure 404 is incident to the membrane 402. The acoustic pressure 404 is coupled (i.e., communicated) to the flexure layer 408 by way of the spine 406. In response to the acoustic pressure 404, the microphone element 400 is displaced by way of tensile strain of the flexures 410, as well as flexure of the membrane 402.

The flexures 410 are understood to include (i.e., exhibit) an electrical characteristic that varies in accordance with the incident acoustic pressure 404. This characteristic can be piezoresistive and/or piezoelectric in nature, and can be provided by way of one or more suitable sensors (not shown; see sensors 218 of FIG. 2) and or doping (not shown, see piezoresistive regions 306 of FIG. 3) or other treatment of the respective flexures 410. In any case, an electric signal corresponding to the acoustic pressure 404 is derived by way of the electrical characteristic of the flexures 410.

Illustrative System

Figure 5:
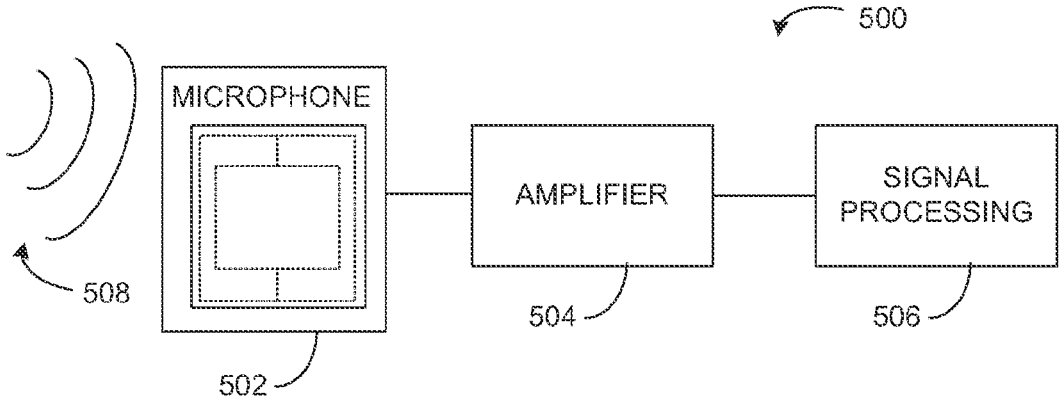
FIG. 5 depicts a block diagram of a system according to one embodiment.

FIG. 5 is a block diagram depicting a system 500 according to another embodiment. The system 500 is depicted in the interest of understanding the present teachings and is illustrative and non-limiting in nature. Thus, numerous other systems, operating scenarios and/or environments can be used.

The system includes a microphone 502. The microphone 502 includes a membrane, spine and flexure layer according to the present teachings. For purposes of understanding, it is presumed that the microphone 502 includes elements consistent with those of the microphone 100 of FIG. 1. Other configurations according to the present teachings can also be used. The system 500 also includes an amplifier 504 and signal processing 506.

In typical operation, the microphone 502 provides an electric signal (i.e., a varying electrical characteristic) in response to incident acoustic energy 508 to the amplifier 504. The amplifier 504 increases the amplitude and/or power of the electric signal, which is then provided to the signal processing circuitry 506. In turn, the signal processing circuitry 506 digitally quantizes the amplified electric signal, filters the signal, identifies and/or detects particular content within the signal, etc., in accordance with any suitable signal processing that is desired. The processed signal can then be put to any suitable use as desired (e.g., recorded, displayed via an oscilloscope or other instrument, audibly produced by way of speakers, etc.). One having ordinary skill in the signal processing arts will appreciate that numerous processing steps can be performed once an electrical signal representative of the acoustic pressure 508 is derived, and further elaboration is not required for purposes of understanding the present teachings.

In one or more embodiments, a microphone (i.e., acoustic transducer) according to the present teachings is formed as a part of an integrated device. In such an embodiment, for example, amplification, signal processing, and/or other circuitry is formed along with microphone elements on a common substrate (or die). In this way, the present teachings can be incorporated as a part of numerous types of micro electromechanical machines (MEMS).

In general, the foregoing description is intended to be illustrative and not restrictive. Many embodiments and applications other than the examples provided would be apparent to those of skill in the art upon reading the above description. The scope of the invention should be determined, not with reference to the above description, but should instead be determined with reference to the appended claims, along with the full scope of equivalents to which such claims are entitled. It is anticipated and intended that future developments will occur in the arts discussed herein, and that the disclosed systems and methods will be incorporated into such future embodiments. In sum, it should be understood that the invention is capable of modification and variation and is limited only by the following claims.

What is claimed is:

1. An apparatus, comprising:

a spine layer;

a membrane layer bonded to the spine layer and to communicate an acoustic pressure to the spine layer; and a flexure layer to which the spine layer is bonded and defining:

a plate to which the spine layer communicates the acoustic pressure communicated to the spine layer by the membrane layer; and a first flexible portion and a second flexible portion, each of the first and second flexible portions configured to exhibit a varying electrical characteristic resulting from a tensile strain of the first and second flexible portions responsive to the acoustic pressure communicated to the plate b the spine, the first flexible portion and the second flexible portion extending directly away from the plate in respective opposite directions.

2. The apparatus according to claim 1, the plate being rectangular in shape.

3. The apparatus according to claim 1, the flexure layer also defining a third flexible portion extending away from the plate in a direction orthogonal to that of both the first and second flexible portions, the third flexible portion configured to exhibit a varying electrical characteristic responsive to an acoustic pressure communicated to the plate.

4. The apparatus according to claim 1 further comprising a support structure defining an acoustic cavity, the plate coupled to the support structure and supported within the acoustic cavity by way of the first flexible portion and the second flexible portion.

5. The apparatus according to claim 4, the flexure layer including the plate and the first flexible portion and the second flexible portion and at least a portion of the support structure being formed from a monolithic semiconductor layer.

6. The apparatus according to claim 1, the spine layer covering that portion of the flexure layer including the plate but neither the first flexible portion nor the second flexible portion.

7. The apparatus according to claim 6, the spine layer defined by a first area, the membrane layer defined by a second area greater than the first area.

8. The apparatus according to claim 1, the first flexible portion and the second flexible portion each including at least one piezoresistive sensor or piezoelectric sensor.

9. A microphone, comprising:

a flexure layer of monolithic material, the flexure layer defining a plate, the flexure layer also defining a first flexible extension and a second flexible extension extending away from the plate in respective opposite directions;

a spine layer covering the plate of the flexure layer; and a membrane layer covering the spine layer, the first and second flexible extensions each configured to exhibit an electrical characteristic varying in accordance with an acoustic pressure incident to the membrane layer, communicated by the membrane layer to the spine layer, and communicated by the spine layer to the plate, the acoustic pressure communicated to the plate causing a tensile strain of the first and second flexible extensions resulted in the electrical characteristic.

10. The microphone according to claim 9 further comprising a support structure, the first flexible extension and the second flexible extension respectively configured to mechanically couple the plate to the support structure.

11. The microphone according to claim 10, the support structure configured to define an acoustic cavity, the plate supported within the acoustic cavity by way of the first flexible extension and the second flexible extension.

12. The microphone according to claim 9, the flexure layer also defining a third flexible extension extending away from the plate in direction different than that of both the first and second flexible extensions, the third flexible extension configured to exhibit an electrical characteristic varying in accordance with an acoustic pressure incident to the membrane layer.

13. The microphone according to claim 9, the first flexible extension and the second flexible extension each configured such that the electrical characteristic is a resistance or a voltage varying in accordance with an acoustic pressure incident to the membrane layer.

14. A transducer configured to exhibit an electrical characteristic varying in accordance with an incident acoustic pressure, the transducer comprising:

a spine layer;

a membrane layer bonded to the spine layer and to communicate an acoustic pressure to the spine layer;

a monolithic semiconductor layer to which the spine layer is bonded and configured to define:

a plate to which the spine layer communicates the acoustic pressure communicated the spine layer by the membrane layer;

a first extension and a second extension extending away from the plate in respective opposite directions, each of the first and second extensions configured such that the electrical characteristic is either piezoresistive or piezoelectric in nature and results from a tensile strain of the first and second extensions responsive to the acoustic pressure communicated to the plate by the spine layer; and at least a portion of a support structure, the support structure defining an acoustic cavity proximate the plate.

* * * * *

UNITED STATES PATENT AND TRADEMARK OFFICE

CERTIFICATE OF CORRECTION

PATENT NO. : 8,737,663 B2
APPLICATION NO. : 13/140329
DATED : May 27, 2014
INVENTOR(S) : Adel Jilani et al.

It is certified that error appears in the above-identified patent and that said Letters Patent is hereby corrected as shown below:

In the Claims,

In column 7, line 25, in Claim 1, delete "b the spine," and insert -- by the spine layer, --, therefor.

Signed and Sealed this
Twenty-fifth Day of November, 2014

Michelle K. Lee

Michelle K. Lee
*Deputy Director of the United States Patent and Trademark Office*